US011199379B1

(12) United States Patent
Lam et al.

(10) Patent No.: US 11,199,379 B1
(45) Date of Patent: Dec. 14, 2021

(54) EOIR AND RF SENSORS FUSION AND TRACKING USING A DUAL EKFS SYSTEM

(71) Applicant: BAE Systems Information and Electronic Systems Integration Inc., Nashua, NH (US)

(72) Inventors: Quang M. Lam, Fairfax, VA (US); Michael J. Choiniere, Merrimack, NH (US); George M. Horihan, Staten Island, NY (US); David A. Richards, Merrimack, NH (US); Jason T. Stockwell, Brookline, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 84 days.

(21) Appl. No.: 16/588,941

(22) Filed: Sep. 30, 2019

Related U.S. Application Data

(60) Provisional application No. 62/738,010, filed on Sep. 28, 2018.

(51) Int. Cl.
*F41G 7/22* (2006.01)

(52) U.S. Cl.
CPC ..... *F41G 7/2246* (2013.01); *F41G 7/2286* (2013.01); *F41G 7/2293* (2013.01)

(58) Field of Classification Search
CPC ..... G01S 13/42
USPC ..... 235/411, 414, 404
See application file for complete search history.

(56) References Cited

U.S. PATENT DOCUMENTS

| | | | | |
|---|---|---|---|---|
| 8,120,526 | B2 | 2/2012 | Holder | |
| 8,854,252 | B2 | 10/2014 | Holder | |
| 9,401,741 | B2 | 7/2016 | Holder et al. | |
| 9,696,418 | B2 | 7/2017 | Holder | |
| 2005/0040280 | A1* | 2/2005 | Hua | G01S 19/54 244/3.1 |
| 2005/0060092 | A1* | 3/2005 | Hablani | B64G 1/288 701/472 |
| 2007/0076917 | A1* | 4/2007 | Chen | G06K 9/3241 382/103 |
| 2008/0314234 | A1* | 12/2008 | Boyd | G06T 7/292 89/1.11 |
| 2017/0227330 | A1* | 8/2017 | Tomich | F41G 7/2293 |
| 2017/0314892 | A1 | 11/2017 | Holder | |

FOREIGN PATENT DOCUMENTS

WO 2007/016098 A2 2/2007

OTHER PUBLICATIONS

"Heterodyne", https://en.wikipedia.org/wiki/Heterodyne, known of at least since Apr. 24, 2019.

(Continued)

*Primary Examiner* — Paultep Savusdiphol
(74) *Attorney, Agent, or Firm* — Scott J. Asmus; KPIP Law, PLLC

(57) ABSTRACT

The system and method for EO/IR and RF sensor fusion and tracking using a dual extended Kalman filter (EKF) system provides a dynamic mixing scheme leveraging the strength of each individual sensor to adaptively combine both sensors' measurements and dynamically mix them based on the actual relative geometries between the sensors and objects of interest. In some cases the objects are adversarial targets and other times they are assets.

12 Claims, 8 Drawing Sheets

(56) References Cited

OTHER PUBLICATIONS

"Interferometry", https://en.wikipedia.org/wiki/Interferometry, known of at least since Apr. 24, 2019.
Monopulse radar, https://en.wikipedia.org/wiki/Monopulse radar, known of at least since Apr. 24, 2019.
"Pulse-Doppler signal processing", https://en.wikipedia.org/wiki/Pulse-Doppler_signal_processing, known of at least since Apr. 24, 2019.
"Undersampling", https://en.wikipedia.org/wiki/Undersampling, known of at least since Apr. 24, 2019.
Armin W. Doerry, "SAR Processing with Stepped Chirps and Phased Array Antennas", Sandia Report, Sandia National Laboratories, Printed Sep. 2006, Albuquerque, NM.
M. Mallick et al., "Angle-only filtering in 3D using Modified Spherical and Log Spherical Coordinates", 14th International conference on Information Fusion, Chicago, Illinois; pp. 1905-1912, Jul. 5-8, 2011.
K. Radhakrishnan et al., "Bearing only Tracking of Maneuvering Targets using a Single Coordinated Turn Model", International Journal of Computer Applications (0975-8887) vol. 1—No. 1, pp. 25-33; 2010.

* cited by examiner

EOIR AND RF SENSORS FUSION AND TRACKING USING A DUAL EKFS SYSTEM

CROSS REFERENCE TO RELATED APPLICATIONS

This application claims the benefit of U.S. Provisional Patent Application No. 62/738,010, filed Sep. 28, 2018, the content of which is incorporated by reference herein its entirety.

FIELD OF THE DISCLOSURE

The present disclosure relates to sensor fusion and more particularly to electro-optical infrared (EO/IR) and radio frequency (RF) sensor fusion and tracking using a dual extended Kalman filter (EKF) tracking system for use in projectile guidance and projectile and target tracking.

BACKGROUND

Several conventional mixing or fusion schemes have been employed for dealing with multiple sources of sensors. Those schemes usually employ static mixing coefficients or a linear combination of two separate filters. There, each filter is designed with a static (constant) mixing coefficient allocated to a portion of the mission fly-out trajectory. These constant, or fixed, coefficients are then timely scheduled to accomplish the mixing goal without taking into account the actual events happening at the mission level.

Wherefore it is an object of the present disclosure to overcome the above-mentioned shortcomings and drawbacks associated with the conventional object tracking and sensor fusion methods.

SUMMARY

It has been recognized that the actual engagement geometry dictates the measurement accuracy of each sensor, e.g., EO/IR and RF sensors, respectively. Those dictating factors or variables include but are not limited to (i) dynamic range variation between projectile and target; (ii) operational altitudes; (iii) line of sight (LOS) angular range and the LOS rate.

One aspect of the present disclosure is a system engineering approach to systematically computing the mixing coefficients of multiple sensors using a dual adaptive mixing system based on the actual event while accounting for certain dictating factors including, but not limited to slant range, altitude, LOS range and LOS rate.

In one embodiment of this approach the system employs the residual vector of each extended Kalman filter (EKF) to dynamically derive the mixing coefficients for each sensor. The residual vector of each EKF associated with each sensor contains the essential information on how well each sensor "sees" and tracks the target. The smaller the residual, the better that sensor observes and tracks the target. This residual vector is then transformed into a likelihood function with which the mixing coefficients are dynamically computed in real-time based on this likelihood function signature (rather than being statically pre-assigned during the design stage as in conventional systems). Therefore, in a sample by sample basis, the system automatically employs the optimal percentage of mixing for each of the two or more sensors, thus guaranteeing a high system accuracy performance for a mission.

One aspect of the present disclosure is a method of sensor fusion and tracking comprising: tracking one or more objects using at least a first sensor and a second sensor, wherein the first sensor provides first sensor measurements and the second sensor provides second sensor measurements in the form of second sensor x, y, and z data; transforming the first sensor measurements from azimuth, elevation and range into first sensor x, y, and z data; calculating a state and a covariance for the first sensor x, y, and z data; updating the state and the covariance for the first sensor x, y, and z data; calculating a state and a covariance for the second sensor x, y, and z data; updating the state and the covariance for the second sensor x, y, and z data; providing truth position data; comparing the truth position data with the first sensor x, y, and z data to produce first sensor x, y, and z comparisons; calculating a first sensor accuracy; comparing the truth position data with the second sensor x, y, and z data to produce second sensor x, y, and z comparisons; calculating a second sensor accuracy; dynamically mixing the first sensor x, y, and z comparisons and the second sensor x, y, and z comparisons to produce fusion sensor x, y, and z comparisons; and calculating a fusion sensor accuracy.

One embodiment of the method of sensor fusion and tracking is wherein mixing is done in real time. In certain embodiments of the method of sensor fusion and tracking mixing is based on mixing coefficients calculated using an interacting multiple model mixing scheme.

Another embodiment of the method of sensor fusion and tracking is wherein the first and the second sensors are co-located on a vehicle. In some cases, the first sensor is active and the second sensor is passive. In certain embodiments, the first sensor is a radio frequency OI3PS sensor and the second sensor is an EO/IR sensor.

A further embodiment provides for a computer program product including one or more machine-readable mediums encoded with instructions that when executed by one or more processors cause a process of guiding projectiles to be carried out, the process comprising: receiving orthogonal interferometry (OI) waveforms at the projectile providing azimuth and elevation information, wherein the OI waveforms are provided by a OI transmitter that is part of a fire control station; receiving mission code and range information at the projectile; transmitting signals from the projectile to an electro-optical infrared detector located proximate the fire control station; processing updates from the fire control station of fused sensor data for guiding the projectile to a target; processing via an on-board processor of the projectile, a plurality of waypoints to a target if unable to obtain updates from the fire control station Yet another embodiment of the method of sensor fusion and tracking is wherein mixing coefficients are calculated using the first sensor covariance and the second sensor covariance. In some cases, mixing is done at a bullet state estimator and a target state estimator output level rather than at a sensor fusion level. In certain embodiments of the method of sensor fusion and tracking the fusion sensor accuracy is less than 3 meters.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION

Figure 1:
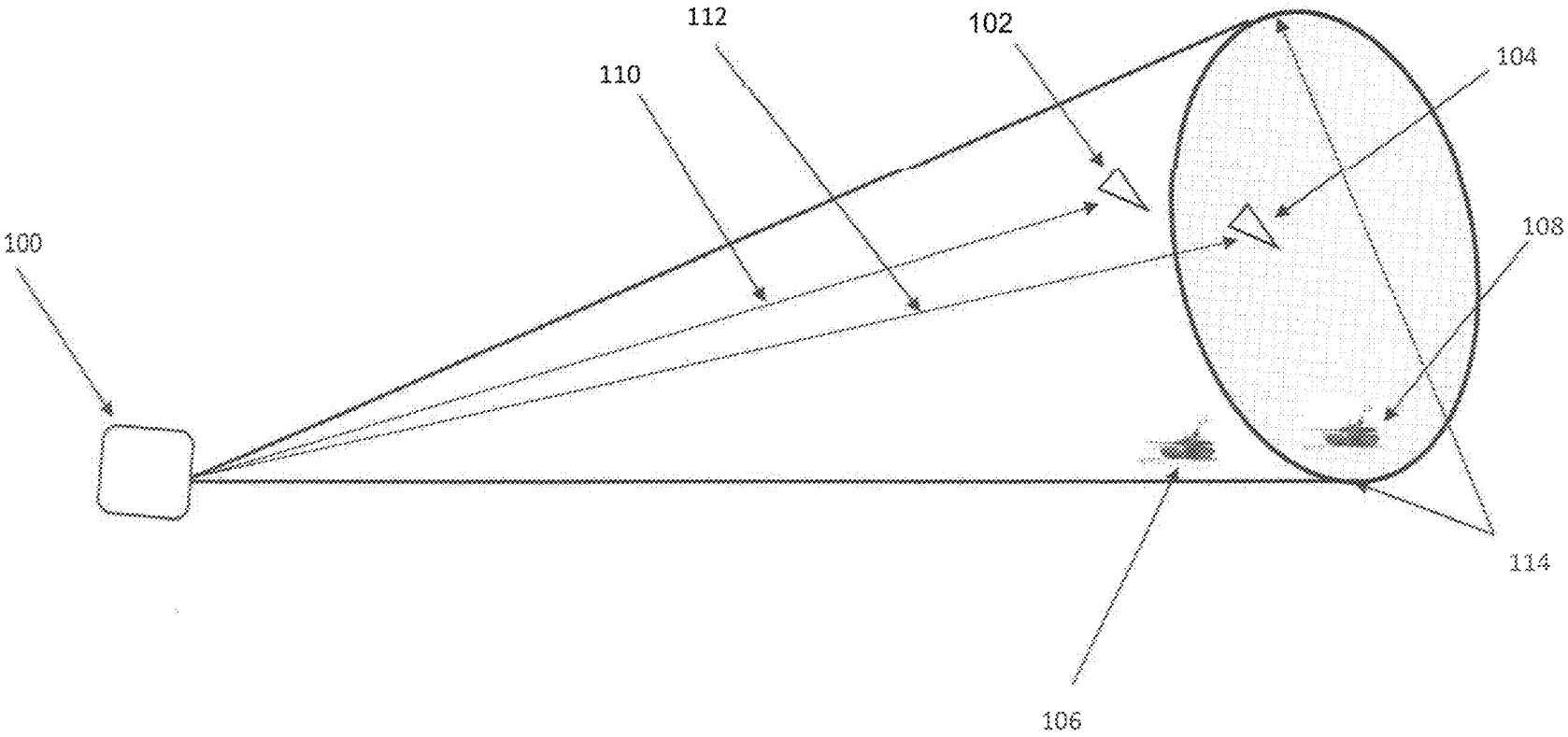
FIG. 1 shows one embodiment of the sensor fusion system as used in the field according to the principles of the present disclosure.

In certain embodiments of the present disclosure the use of multiple sensors based on their disparate performance specifications and measurements nature; i.e., active RF based sensors are more accurate in range measurements but less accurate in angle measurements, while passive EO/IR based sensors are very accurate in angle measurements but offer no range measurements. The present system achieves better object tracking (i.e., either bullet or target) from a remote sensing perspective. Here, dynamically mixing two or more sensors in order to achieve a better performance (enhanced accuracy) and more robust fashion provides for fusion sensor accuracy of less than 3 meters, which is well below conventional techniques.

Conventional design techniques typically use a rule based or linear combination based design approach which statically assigns a mixing ratio between two sensors and implements them in a gain scheduling scheme to address the dynamic engagement situation between sensors and objects that a fire control system (FCS) may be tracking. These static gain matrices implemented in a gain scheduling scheme are not able to address real time dynamic engagement conditions which are difficult to predict during the design stage; therefore, the performance of conventional systems is limited and severely degraded when dealing with an engagement flight condition which drastically deviates from gain scheduling design assumptions.

One embodiment of the system of the present disclosure tracks one or more objects (e.g., munitions, targets) using a combination of at least two sensors in real time. In some cases, one sensor is an active sensor and the other sensor is a passive sensor. In general, an active sensor is a device that requires an external source of power to operate and a passive sensor detects and responds to input from the physical environment without the use of an external power source. In general, sensor fusion combines the sensory data from disparate sources (two or more different sensors) such that the resulting information has less uncertainty than when the disparate sources are used individually. The reduction uncertainty may refer to more accurate, more complete, and/or more dependable results.

In certain embodiments, the sensor fusion system calculates how much weight each of the two or more sensors should be given to provide the best results. In some cases, the mixing differences for the two or more sensors are determined using an interacting multiple model (IMM). In one embodiment, the system provides sensor fusion using a combination of an active (RF) sensor, namely an orthogonal interferometry (OI) precision pulse positioning system (3PS), and an electro-optical infrared (EO/IR) passive sensor. In some cases, the EO/IR and RF sensor mixing scheme is accomplished at the sensor level. In some embodiments, the sensor mixing scheme is accomplished at the track level, or at the bullet state estimator and/or target state estimator module output levels. In certain embodiments, both the EO/IR and RF based (OI3PS) sensors are implemented on a tank, or other vehicle.

In one embodiment of the system of the present disclosure, a two way OI3PS reference frame is used for bullet, or munition, tracking with an angle accuracy of less than 100 μrad and a range accuracy of less than 5 meters. In one embodiment of the system of the present disclosure, EO/IR is used for simultaneous tracking of both a target and a munition (e.g., a bullet) with an angle resolution of less than 30 μrad. In certain embodiments, Bluetooth or ZigBee wireless communication are used for ground to bullet and bullet to bullet communication, particularly when the OI3PS is heavily contaminated by multi-path and clutter signals, which are often present in the field. In particular, this environment may occur below some altitude threshold and the wireless communication system may serve as backup to a baseline bullet data link (BDL). The BDL is designed using RF based communication allowing a ground based fire control system (FCS) to communicate with the bullet and command it where to go to achieve a successful interception during a mission.

Referring to FIG. 1, one embodiment of the sensor fusion system of the present disclosure is shown. More specifically, in one embodiment a co-located dual sensor fusion system 100 is mounted on a vehicle. In one example, the vehicle is a ground vehicle such as a car, truck, tank, or armored vehicle carrier. The vehicle can also be air-borne or maritime based. In this embodiment, an EO/IR and OI3PS dual sensor fusion system, residing in the FCS software, is implemented on a tank, or other mobile vehicle. The system 100 includes the hardware and software for the OI3PS system that allows for a projected RF grid and the hardware and software for EO/IR system providing optical and infrared detection and guiding capability.

The system (e.g., the OI3PS and RF sensor fusion module) 100 in this example is being used to track two assets 102, 104 as well as the location of two targets 106, 108 (e.g., adversary). The assets 102, 106 in one example include rockets, rocket propelled grenades, missiles, precision guided munitions, drones, railgun projectiles, or the like. In one embodiment, the EO/IR field of view (FOV) 114 projects a grid and tracks multiple objects (e.g., assets and targets). In one embodiment, the OI3PS signals 110,112 from the grid and are each shown being received by the assets such as from a rear-facing antenna on the asset and guiding a single asset (the line from sensor to the bullet/munition representing the OI3PS viewing of the sensor and its communication link).

Still referring to FIG. 1, in one embodiment of the sensor fusion system of the present disclosure two extended Kalman filters (EKFs) are implemented on the ground system. In one embodiment, one EKF is dedicated to an EO/IR sensor's measurements which are processed to track/estimate multiple trajectories, for example, both assets (e.g., bullets) and targets. In one embodiment, one EKF is dedicated to one or more OI3PS sensor measurements that are processed to track/estimate assets' trajectories. In one embodiment, information sharing between the two EKFs as well as relative range information among the one or more assets and the ground are used to derive needed information when the OI3PS sensor is no longer contributing to the object tracking.

In certain embodiments of the system of the present disclosure, the EO/IR/EKF is equipped to perform multiple object measurements processing and perform object track file management to keep track of both multiple munitions (e.g., bullets) and multiple targets to produce order of engagement activation information that can be utilized by system users and the like. In certain embodiments, the EO/IR/EKF is equipped to perform multiple measurements data association, e.g., bookkeeping for respective tracks (or state estimate vectors) of both munitions and targets to provide recommended weapon to target assignment (WTA) decisions that can be utilized by system users and the like. In certain embodiments, the OI/EKF will primarily collect munitions' measurements and produce respective tracks or bullet state estimate (BSE) vectors. In some embodiments, BSEs produced by both the EO/IR and OI3PS sensors are fused at the tracking level (as compared to the sensor level) using a modified interacting multiple model (IMM) based mixing scheme.

Certain embodiments of the system provide an elegant mixing of EO/IR angular high accuracy with OI/RF sensor measurements to enhance the BSEs accuracy to ensure that a guidance subsystem is getting the best possible knowledge of the bullets' state vector estimate (e.g., what is the bullets' current trajectory). In some cases, a derived range can be used in the EO/IR/EKF to further enhance the angle only BSE solution.

Certain embodiments of the system enhance the object state estimator (OSE) accuracy of angle only (bearing) measurements (i.e., azimuth and elevation angles) provided by a passive seeker (EO/IR) by mixing it with an active RF based OI3PS sensor. The OSE is accomplished using an EKF and the "object" is actually multiple objects such as guided bullets and multiple targets to be tracked and/or engaged. One challenge for the system is to maintain the bullet state estimate (BSE) accuracy and target state estimate (TSE) accuracy simultaneously so that continuous and persistent BSE and TSE can be used to feed a guidance subsystem in order to achieve an acceptable circular error probable (CEP) performance (e.g. <3 meters) for one or more assets. As used herein, the CEP is a measure of a weapon system's precision. It is defined as the radius of a circle, centered on the mean, whose boundary is expected to include the landing points of 50% of the rounds. In certain cases, off-board sensor implementation may be used to consistently produce both BSE and TSE signatures for an acceptable intercept.

Figure 2:
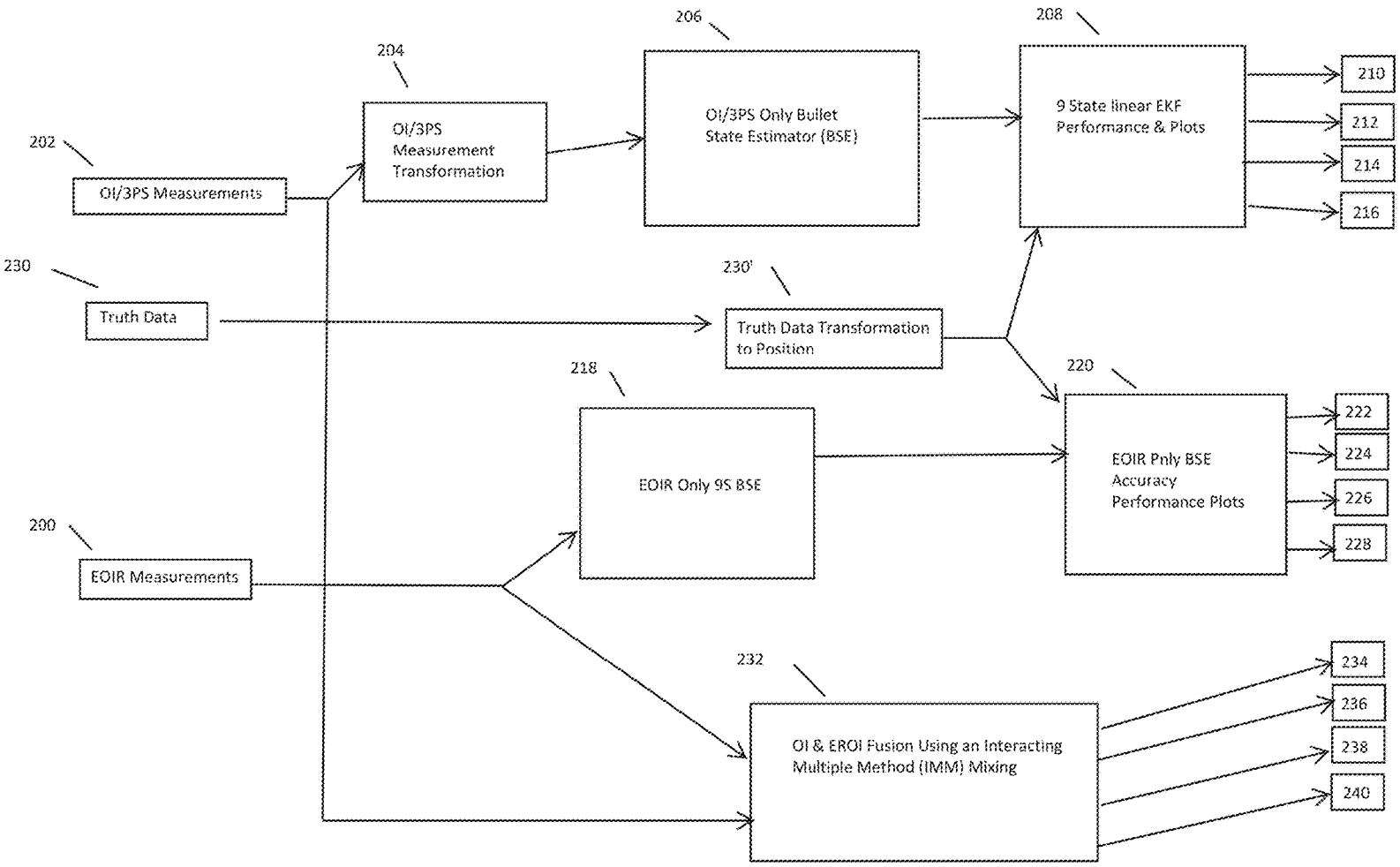
FIG. 2 is a diagram of one embodiment of the sensor fusion system according to the principles of the present disclosure showing location accuracy enhancement.

Referring to FIG. 2, a diagram of one embodiment of the sensor fusion system according to the principles of the present disclosure showing location accuracy enhancement is shown. More specifically, one embodiment of the present sensor fusion system utilizes EO/IR sensor measurements 200 and OI3PS sensor measurements 202 to track multiple projectiles such as precision guided munitions as well as targets in the field. The OI3PS measurements 202 are transformed from azimuth, elevation, and range into x, y, and z via a transformation module 204. The x, y, z data enters the OI3PS only bullet state estimator (BSE) module 206 where seeker pseudo linear measurements are used to produce updated state information and updated covariance information. Next, truth data 230 is fed into an OI3PS BSE performance module 208 and linear EKF performance and plots are generated using x, y, and z comparisons for the OI3PS only data with the truth data to generate OI3PS x 210, OI3PS y 212, OI3PS z 214, and OI3PS RSS accuracy 216. In this example, the OI3PS only RSS accuracy was 0.9684 meters which is well within the required error basket of 3 meters for missions of this type. The truth data is generated using high fidelity simulation data. The truth data does not take into account sensor losses or environmental noise, for example.

In certain embodiments of the system of the present disclosure, the EO/IR measurements 200 enter an EO/IR only bullet state estimator (BSE) module 218 where updated state (where) information and updated covariance (error) information is processed and stored. Next, EO/IR BSE performance and plots are generated in the EO/IR BSE performance module 320 using x, y, and z comparisons for the EO/IR only data with the truth data 230 to produce the EO/IR x 222, EO/IR y 224, EO/IR z 226, and EO/IR RSS accuracy 228. In this example, the EO/IR only RSS accuracy was 19.68 meters.

Still referring to FIG. 2, truth data 230 from a file is fed into a truth data transformation module 230' which is used to feed truth data into the OI3PS BSE performance module 208 and the EO/IR BSE performance module 220 to allow for comparisons and covariance calculations. As used herein, truth data is being generated by the math model and physics based principles according to the principles of the present disclosure with no sensor noise or environmental noise.

An EO/IR and OI3PS fusion module 232 comprising an interacting multiple model (IMM) receives the EO/IR measurements 200 and the OI3PS measurements 202 and mixes them at the track, or BSE/TSE, level to create x, y, and z comparisons and RSS fusion error information for the EO/IR and OI3PS fusion data resulting in EO/IR and OI3PS x 234, EO/IR and OI3PS y 236, EO/IR and OI3PS z 238, and EO/IR and OI3PS RSS accuracy 240 data. In this example, the EO/IR and OI3PS RSS accuracy was 0.5441 m, which is less than the error attributed to either sensor alone.

Figure 3A:
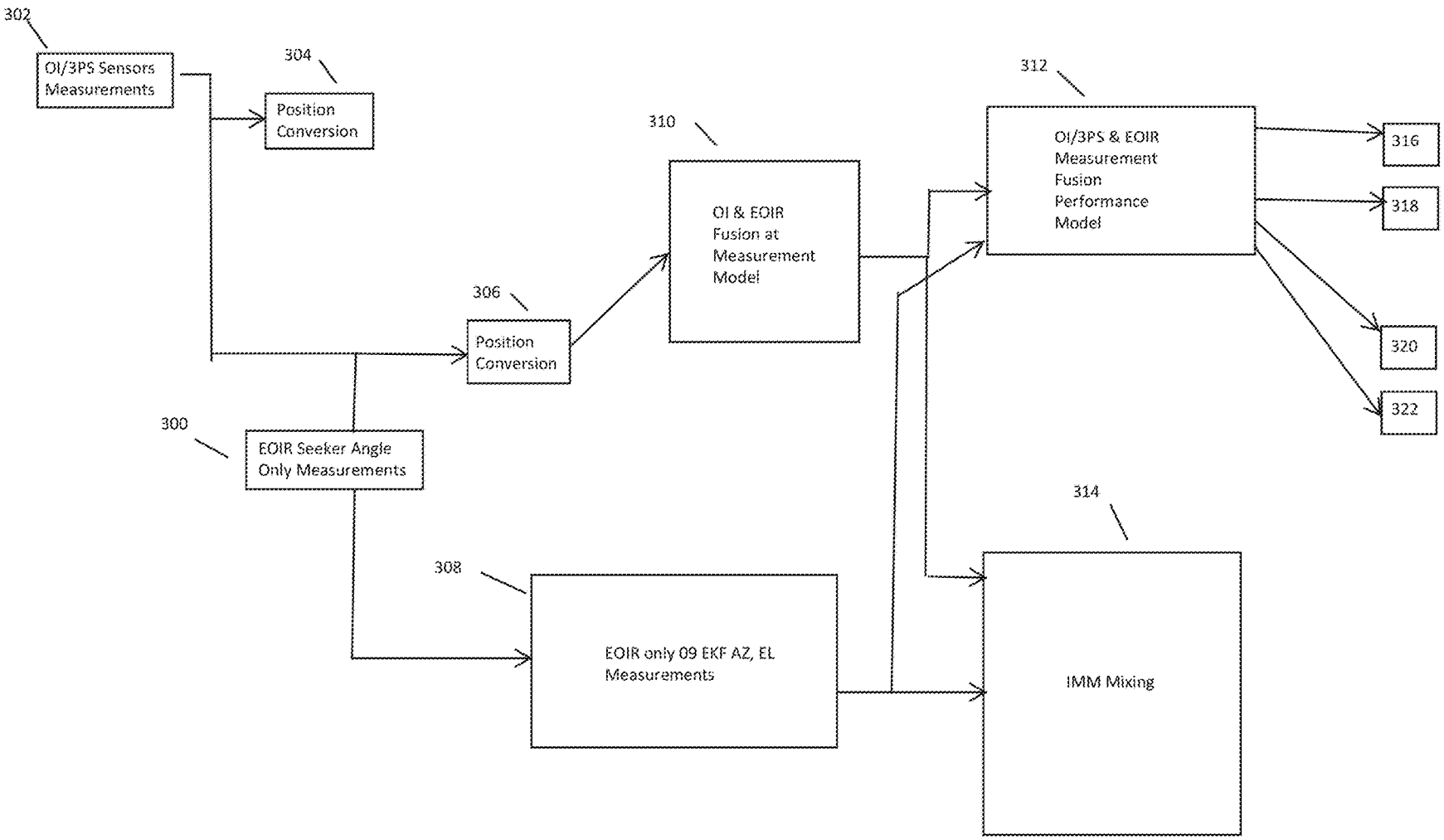
FIG. 3A is a diagram of one embodiment of the sensor fusion system according to the principles of the present disclosure.

Referring to FIG. 3A, a diagram of one embodiment of the sensor fusion system according to the principles of the present disclosure is shown. More specifically, one embodiment of the present sensor fusion system utilizes EO/IR sensor measurements 300 and OI3PS sensor measurements 302 to track multiple munitions and targets in the field. The OI3PS measurements 302 are transformed from azimuth, elevation, and range into x, y, and z via a transformation module 304. In certain embodiments of the system of the present disclosure, the EO/IR measurements 320 enter an EO/IR only EKF module 308 where updated state information and updated covariance information is processed and stored. In certain embodiments, the OI3PS and EO/IR fusion is accomplished at the measurement level using a single EKF with measurement fusion. The x, y, z data enters the single EKF fusion module 310 where seeker pseudo linear measurements are used to produce updated fused state information and updated fused covariance information. Next, truth data is fed into an OI3PS and EO/IR fusion performance module 312, and an EO/IR and OI3PS fusion module 314 comprising an interacting multiple model (IMM) receives the EO/IR measurements 300 and the OI3PS measurements 302 and mixes them at the track, or TSE, level to create x, y, and z comparisons and RSS fusion error information for the EO/IR and OI3PS fusion data resulting in EO/IR and OI3PS x 316, EO/IR and OI3PS y 318, EO/IR and OI3PS z 320, and EO/IR and OI3PS RSS accuracy 322 data. As used herein, truth data is being generated by the math model and physics based principles according to the principles of the present disclosure with no sensor noise or environmental noise.

Figure 3B:
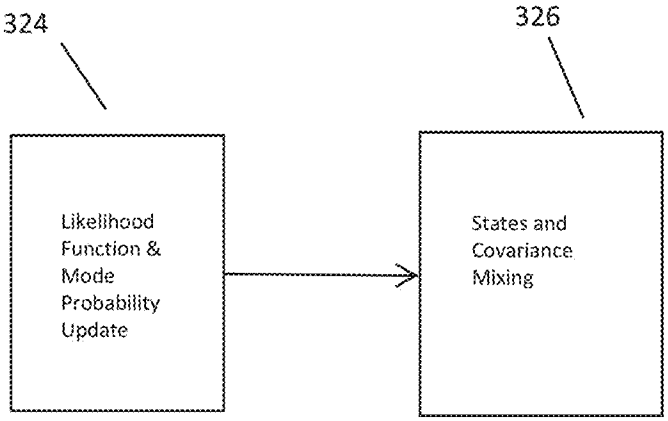
FIG. 3B is a diagram of one embodiment of the sensor fusion system according to the principles of the present disclosure.

Referring to FIG. 3B, a diagram of one embodiment of the sensor fusion system according to the principles of the present disclosure is shown. More specifically, one embodiment of the likelihood function and mode probability update module 324 is shown with one embodiment of the mixing module 326.

Figure 4A:
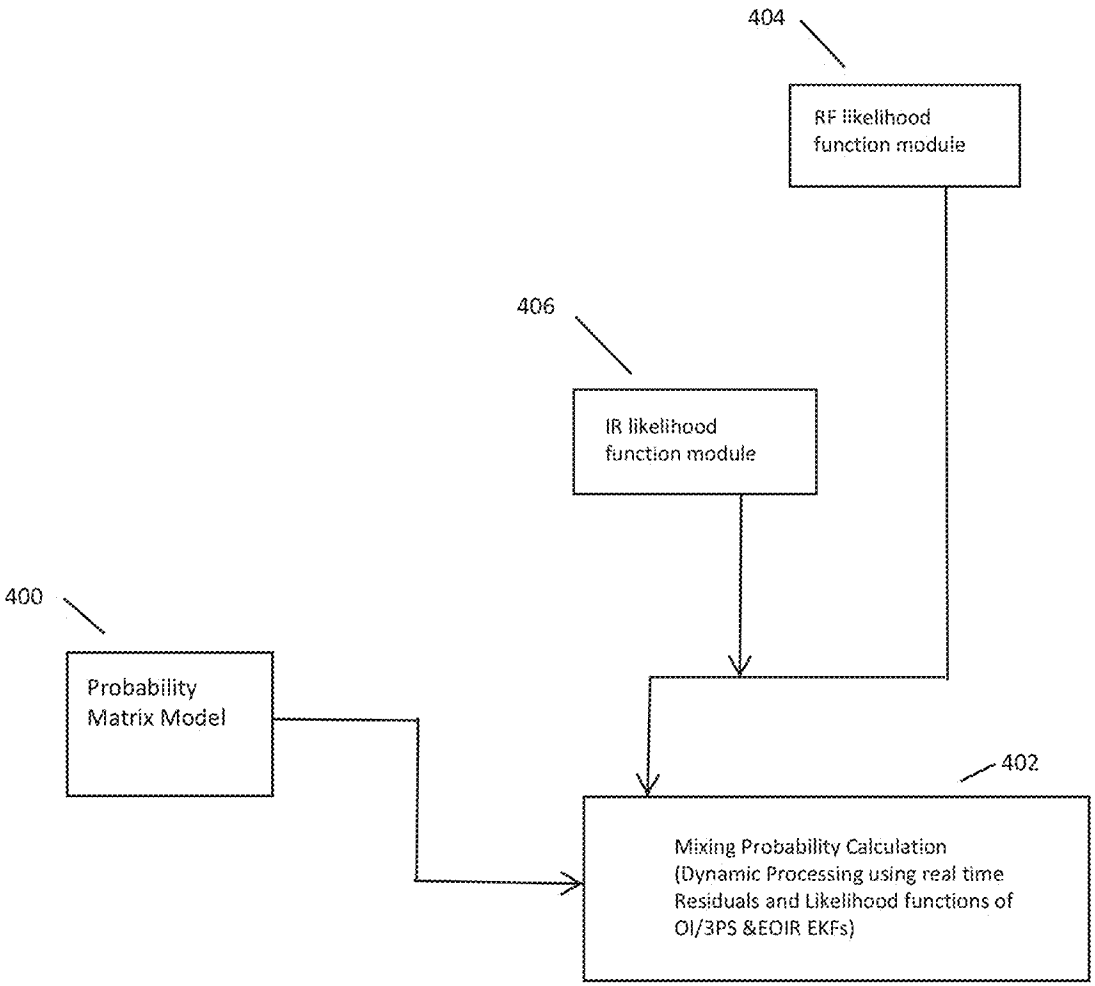
FIG. 4A is a diagram of one embodiment of the sensor fusion system according to the principles of the present disclosure showing sensor mixing coefficients.

Referring to FIG. 4A, a diagram of one embodiment of the sensor fusion system according to the principles of the present disclosure with sensor mixing coefficients is shown. More specifically, a probability matrix module 400 is shown providing input for a mixing probability calculation module 402. One embodiment of the mixing probability calculation module is shown in more detail in FIG. 4B. In some embodiments, the probability matrix module 400 uses EO/IR and OI3PS sensor information and comprises a transition matrix. In some cases, the module utilizes a stochastic process such as Markov chain. In certain embodiments of the system of the present disclosure, each sensor has a likelihood function module. In this figure, the RF sensor has an RF likelihood function module 404 and the IR sensor has an IR likelihood function module 406.

Figure 4B:
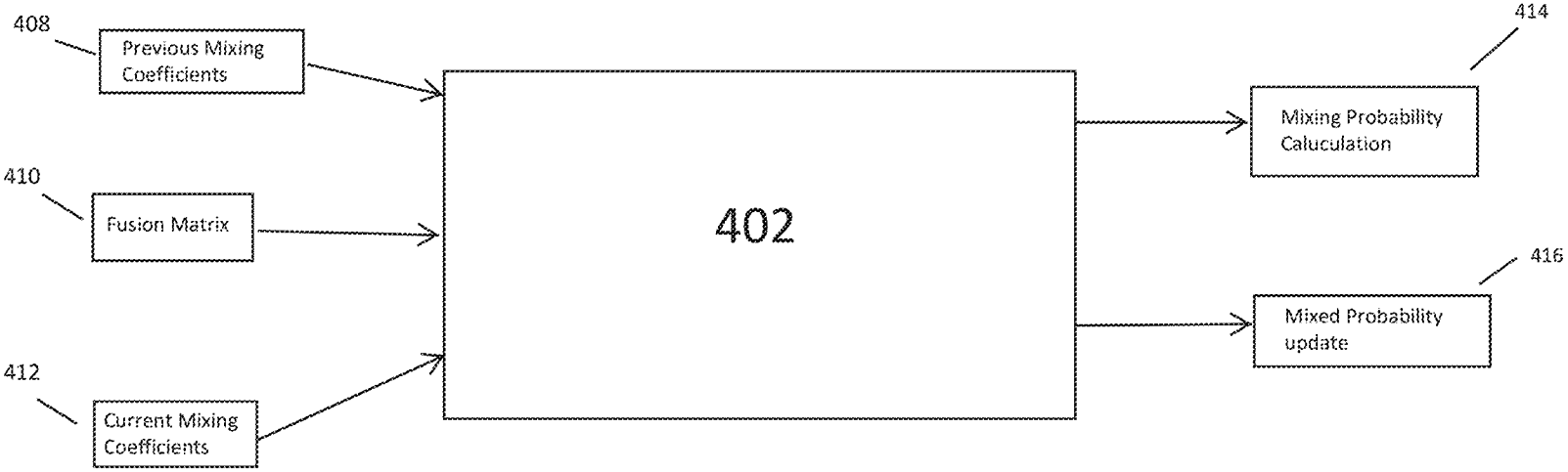
FIG. 4B is a diagram of one embodiment of the sensor fusion system showing interacting multiple model dual mode mixing according to the principles of the present disclosure.

Referring to FIG. 4B, a diagram of one embodiment of the sensor fusion system according to the principles of the present disclosure showing interacting multiple model dual mode mixing is shown. More specifically, predicted probability calculations are used in a mixing probability calculation module 402. Here, previous mixing coefficients 408, a fusion matrix 410, and current mixing coefficients 412 are used to produce real-time sensor fusion mixing to calculate, mixing probability 414, mixed probability updates 416 and location results having increased accuracy over the use of individual sensors.

Certain embodiments of the sensor fusion system of the present disclosure provide for sensor data mixing on-the-fly and in real-time. In some cases, the mixing is based on actual data and on the respective confidences for each sensor data used in the fusion system. In one embodiment, it is important to know how much of each sensor data to use. In one embodiment of the system, is it important to know when to use a certain sensor data. In some cases, the mixing percentages are based on confidence in the data as determined by the inverse of the reading error for a particular sensor (i.e., likelihood function).

Figure 5:
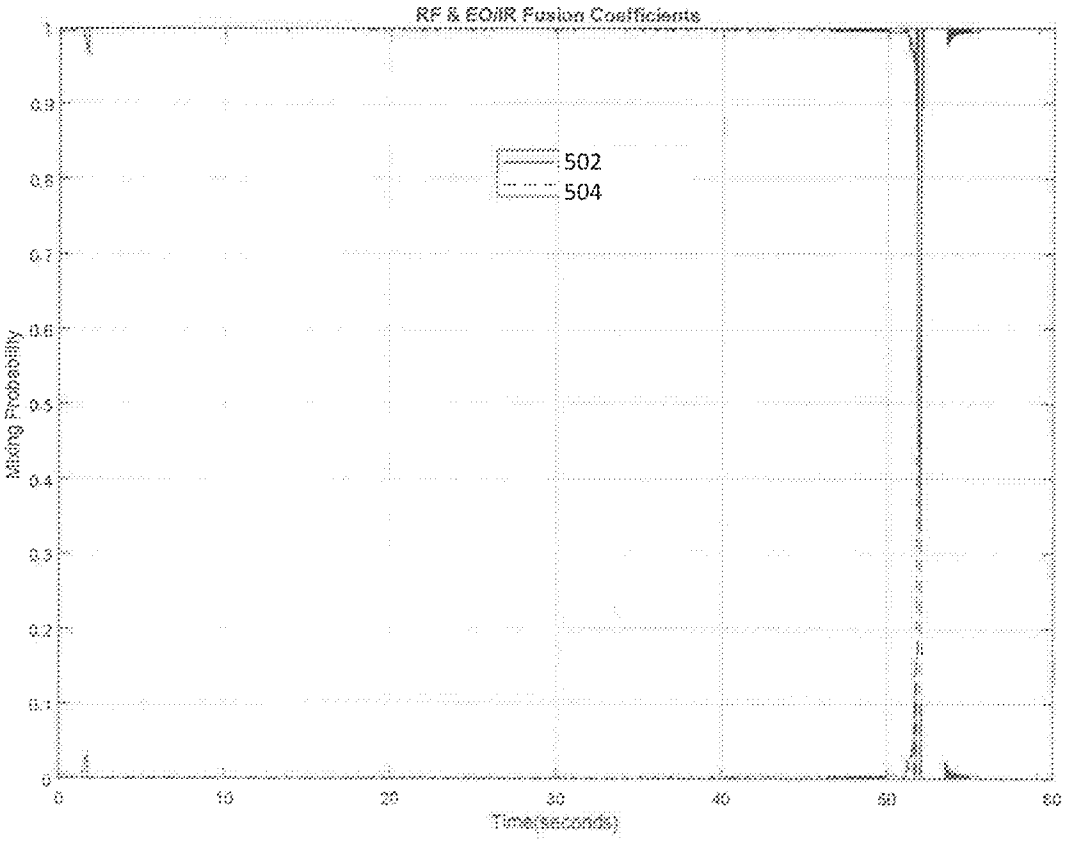
FIG. 5 is a plot of fusion coefficients for two sensors according to the principles of the present disclosure according to one embodiment.

Referring to FIG. 5, a plot of fusion coefficients for two sensors according to the principles of the present disclosure is shown. More specifically, the upper trace is from the OI3PS sensors and the probability of use for the OI3PS sensors in one embodiment is about 90% in early stages of tracking and then at time 52 seconds a hand off to the EO/IR 504 sensor is done. The OI3PS primarily dictates/drives the BSE with its measurements due to good range information from the OI/RF 502. Guidance is then passed back to the EO/IR 504 after 52 seconds where a 50/50 mixing occurs and it is down to only 33% at 53 seconds in one example.

In certain embodiments, Model-Conditional Reinitialization (for j=1, . . . ,r) utilizes the calculation of Predicted Mode Probability according to Eq. 1:

$$\hat{\mu}_j(n+1\mid n) =: P\{m_j(n+1)\mid Z^n\} = \sum_{i=1}^{r} p_{ij}\mu_i(n) \qquad \text{Eq. 1}$$

the calculation of Mixing Probabilities according to Eq. 2:

$$\mu_{i|j}(n) =: P\{m_i(n)\mid m_j(n+1), Z^n\} = p_{ij}\mu_i(n)/\hat{\mu}j(n+1\mid n) \qquad \text{Eq. 2}$$

$$\mu_i(n) = \frac{\hat{\mu}_j(n\mid n-1)L_j(n)}{\sum_i \hat{\mu}_i(n\mid n-1)L_i(n)}$$

where and the likelihood function, $L_j(n)$, is computed as follows, $$L_j(n) = \frac{1}{\sqrt{(2\pi)|S_j(n)|}} e^{\left[-\frac{1}{2}v_j(n)' S_j^{-1}(n) v_j(n)\right]}$$

Next, calculation of Mixing Estimate according to Eq. 3:

$$\hat{x}_j^0(n\mid n) = \sum_{i=1}^{r} \hat{x}_i(n\mid n)\mu_{i|j}(n) \qquad \text{Eq. 3}$$

and the calculation of Mixing Covariance according to the following equation:

$$P_j^0(n\mid n) = \sum_{i=1}^{r} \mu_{i|j}(n\mid n)\cdot\{P_i(n\mid n) + [\hat{x}_i(n\mid n) - \hat{x}_j^0(n\mid n)]\cdot[\hat{x}_i(n\mid n) - \hat{x}_j^0(n\mid n)]'\}$$

In certain embodiments, prediction and update calculations for Model-Conditional Filtering are utilized through a prediction stage:

$$\hat{x}_j(n+1\mid n) = \Phi\cdot\hat{x}_j^0(n\mid n)$$

$$P_j(n+1\mid n) = \Phi(n)\cdot P_j(n\mid n)\cdot\Phi(n) + Q(n)$$

with a Measurement Residual according to: $v_j = z(n+1)\ H_j(n+1)\hat{x}_j(n+1\mid n)$ and a residual or Output Covariance according to: $S_j = H(n+1)\ P_j(n+1\mid n)\ H(n+1)' + R(n+1)$. Next, Filter Gain is calculated using $K_j\ (n+1) = P_j(n+1\mid n)H\cdot S_j(n+1)^{-1}$ followed by an Update Stage according to the following:

$$\hat{x}_j(n+1\mid n+1) = \hat{x}_j(n+1\mid n) + K_j(n+1)\cdot v_j$$

$$P_j(n+1\mid n+1) = P_j(n+1\mid n) - K_j(n+1)S_j(n+1)K_j(n+1)'.$$

In certain embodiments, estimates are calculated where an overall estimate utilizes the following equation: $\hat{x}(n+1\mid n+1) = \Sigma_j\hat{x}_j(n+1\mid n+1)\mu_j(n+1)$ and an overall covariance utilizes the following equation:

$P(n+1\mid n+1) = \Sigma[Pj(n+1\mid n+1) + \lambda(n+1)\lambda(n+1)']\mu_j(n+1)$ where $\lambda(n+1) = [\hat{x}(n+1\mid n+1) - \hat{x}_j(+1\mid n+1)]$.

The ability to mix active and passive sensors to provide accurate information about multiple objects that are being tracked can be extended to address video mixing as well. With the baseline and extension described herein, the technology can be applied to current and future autonomous systems like Automated Driver Assistant Systems, and the like, for the commercial automobile industry. Likewise, unmanned ground based vehicles could also benefit from the design approach of the present disclosure, including traffic tracking and management and collision avoidance, for example.

In certain embodiments, the system can by run using system or guidance software. In some cases, the system can be run on an FPGA-implemented sensor hosted by a mobile platform. In other cases, the system can be run onboard a vehicle. The computer readable medium as described herein can be a data storage device, or unit such as a magnetic disk, magneto-optical disk, an optical disk, or a flash drive. Further, it will be appreciated that the term "memory" herein is intended to include various types of suitable data storage media, whether permanent or temporary, such as transitory electronic memories, non-transitory computer-readable medium and/or computer-writable medium.

Figure 6:
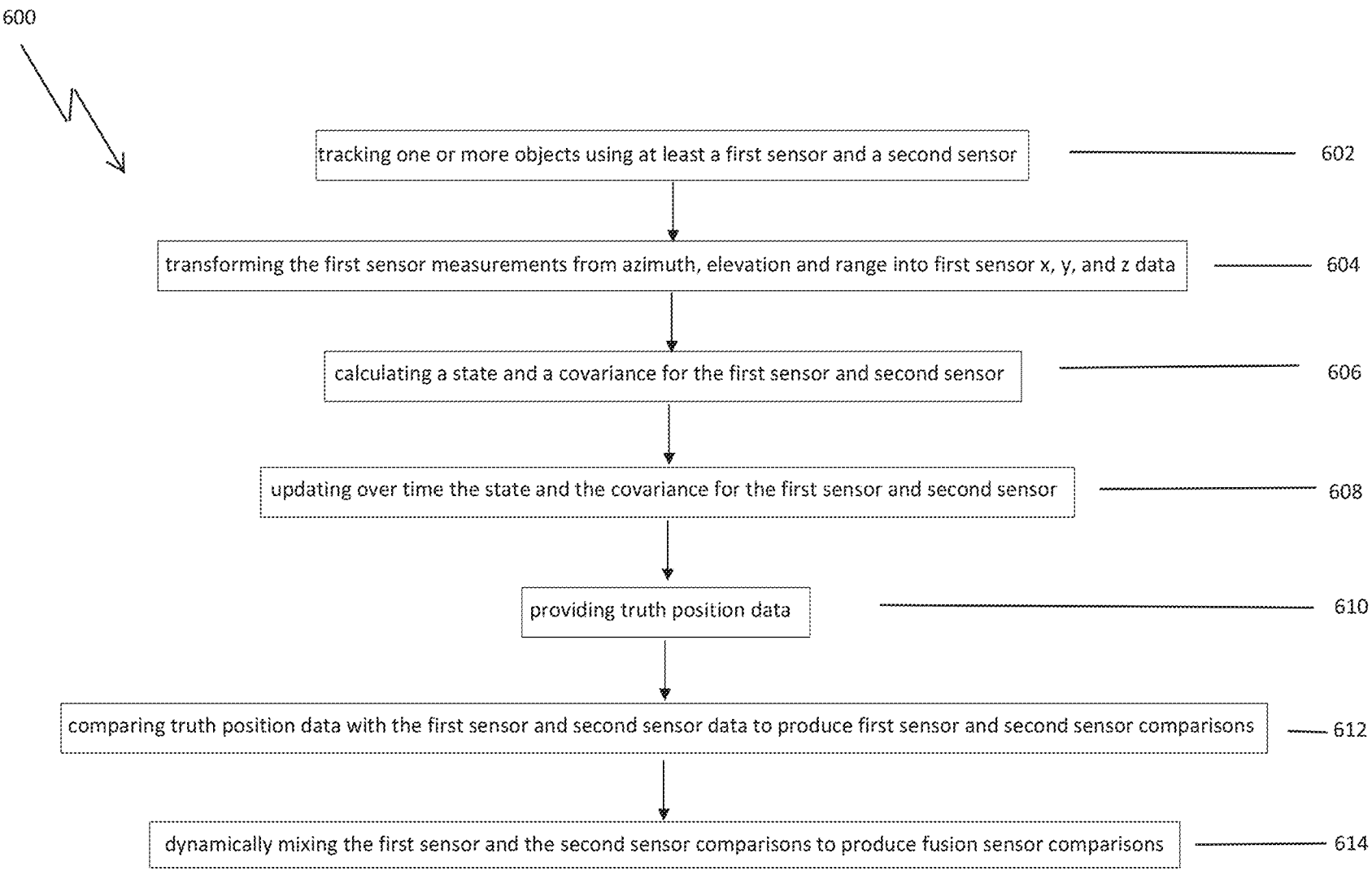
FIG. 6 is a flow chart of one embodiment of a method of the present disclosure.

FIG. 6 is a flow chart 600 of one embodiment of a method of the present disclosure. More specifically, the system tracks one or more objects using at least a first and a second sensor 602. The sensor measurements are transformed from azimuth, elevation, and range into x, y, and z 604. A state and covariance is calculated for the first and the second sensor 606. The state and covariance are updated for the first and second sensor 608. Providing truth position data 610 and comparing the truth position data with the first and second sensor data to produce first and second sensor comparisons 612. Dynamically mixing the first and second sensor comparisons to produce sensor fusion comparisons 614 for more accurate guidance.

According to one example embodiment, the precision guided munitions are tracked and guided to the targets by the FCS that includes the OI3PS system providing the OI reference frame and that provides OI waveforms for each projectile that enables azimuth and elevation information that is combined with range information obtained from communications with the transmitter station. The munition in this example has a rearward facing antenna to receive information from the transmitter station as well as transmit information back to the transmitter station. The munition include a receiver for the RF and or other wireless communications and on-board processor with software for processing the information. In one example the information includes polar coordinates that are used to establish waypoints to the targets.

It will be appreciated from the above that the invention may be implemented as computer software, which may be supplied on a storage medium or via a transmission medium such as a local-area network or a wide-area network, such as the Internet. It is to be further understood that, because some of the constituent system components and method steps depicted in the accompanying Figures can be implemented in software, the actual connections between the systems components (or the process steps) may differ depending upon the manner in which the present invention is programmed. Given the teachings of the present invention provided herein, one of ordinary skill in the related art will be able to contemplate these and similar implementations or configurations of the present invention.

It is to be understood that the present invention can be implemented in various forms of hardware, software, firmware, special purpose processes, or a combination thereof. In one embodiment, the present invention can be implemented in software as an application program tangible embodied on a computer readable program storage device. The application program can be uploaded to, and executed by, a machine comprising any suitable architecture.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A method of sensor fusion and tracking comprising:

tracking one or more assets and targets using at least a first sensor and a second sensor, wherein the first sensor provides a plurality of first sensor measurements and the second sensor provides a plurality of second sensor measurements in the form of a plurality of second sensor x, y, and z data;

transforming the plurality of first sensor measurements from azimuth, elevation and range into a plurality of first sensor x, y, and z data;

calculating a state and a covariance for the plurality of first sensor x, y, and z data;

updating over time the state and the covariance for the plurality of first sensor x, y, and z data;

calculating a state and a covariance for the plurality of second sensor x, y, and z data;

updating over time the state and the covariance for the plurality of second sensor x, y, and z data;

providing a plurality truth position data;

comparing the plurality of truth position data with the plurality of first sensor x, y, and z data to produce a plurality of first sensor x, y, and z comparisons;

calculating a first sensor accuracy;

comparing the plurality of truth position data with the plurality of second sensor x, y, and z data to produce a plurality of second sensor x, y, and z comparisons;

calculating a second sensor accuracy;

dynamically mixing the plurality of first sensor x, y, and z comparisons and the plurality of second sensor x, y, and z comparisons to produce a plurality of fusion sensor x, y, and z comparisons, wherein the dynamic mixing is done at a bullet state estimator and a target state estimator output level rather than at a sensor fusion level; and calculating a fusion sensor location accuracy of the one or more assets and targets;

wherein the first sensor is a radio frequency orthogonal interferometry precision pulse positioning system (OI3PS) sensor and the second sensor is an electro-optical/infrared (EO/IR) sensor.

2. The method of sensor fusion and tracking according to claim 1, wherein the dynamic mixing is done in real time.

3. The method of sensor fusion and tracking according to claim 2, wherein the dynamic mixing is based on a plurality of mixing coefficients calculated using an interacting multiple model mixing scheme.

4. The method of sensor fusion and tracking according to claim 3, wherein the plurality of mixing coefficients are calculated using the first sensor covariance and the second sensor covariance.

5. The method of sensor fusion and tracking according to claim 1, wherein the first and the second sensors are co-located on a vehicle.

6. The method of sensor fusion and tracking according to claim 1, wherein the first sensor is active and the second sensor is passive.

7. The method of sensor fusion and tracking according to claim 1, wherein communicating between the one or more assets is by radio frequency, Zigbee, and Bluetooth.

8. The method of sensor fusion and tracking according to claim 1, wherein the sensors are located on a platform and further comprising communicating between the assets and the platform is by radio frequency, Zigbee, and Bluetooth.

9. A precision guided munition navigation system, comprising:

a radio frequency orthogonal interferometry system for projecting a radio frequency grid for tracking range information for at least one asset for an initial time period;

an electro-optical IR system for tracking the at least one asset at a second time period and providing accurate angular information; and a bullet state estimator and a target state estimator output module for determining a transition from the initial time period to the second time period in real-time based in part on a plurality of mixing coefficients calculated using an interacting multiple model mixing scheme, wherein the model mixing is done at an output level of the bullet state estimator and the target state estimator output level rather than at a sensor fusion level.

10. A computer program product including one or more machine-readable mediums encoded with instructions that when executed by one or more processors cause a process of guiding a projectile to be carried out, the process comprising:

receiving orthogonal interferometry ((ill) waveforms at the projectile providing azimuth and elevation information, wherein the OI waveforms are provided by an OI transmitter that is part of a fire control station and for a reference frame;

receiving mission code and range information at the projectile from the fire control station;

transmitting signals from the projectile to an electro-optical infrared detector located proximate the fire control station;

processing updates from the fire control station of fused sensor data for guiding the projectile to a target via navigation waypoints, wherein the fused sensor data is processed using a dual extended Kalman filter; and processing via an on-board processor of the projectile, a plurality of alternative waypoints to a target if unable to obtain updates from the fire control station.

11. The computer program product according to claim 10, wherein the projectile and the fire control station communicate by radio frequency, Bluetooth or Zigbee.

12. The computer program product according to claim 10, further comprising communicating with at least one other projectile by Bluetooth or Zigbee.

* * * * *